United States Patent [19]

Dokonal

[11] Patent Number: 5,069,177

[45] Date of Patent: Dec. 3, 1991

[54] PRELUBRICATION APPARATUS

[76] Inventor: Jindrich Dokonal, Mt. View Ave. #11, Mt. View, Calif. 94040

[21] Appl. No.: 636,189

[22] Filed: Dec. 31, 1990

[51] Int. Cl.[5] ..... F01M 1/18

[52] U.S. Cl. ..... 123/196 S; 123/196 R

[58] Field of Search ..... 123/196 S, 196 R; 251/129.15

[56] References Cited

U.S. PATENT DOCUMENTS

| | | | |
|---|---|---|---|
| 2,755,787 | 7/1956 | Butler et al. | 123/196 S |
| 3,583,525 | 6/1971 | Holcomb | 123/196 S |
| 4,061,204 | 12/1977 | Kautz, Jr. | 123/196 S |
| 4,538,645 | 9/1985 | Perach | 251/129.15 |

*Primary Examiner*—E. Rollins Cross

*Assistant Examiner*—Erick Solis

*Attorney, Agent, or Firm*—Leon Gilden

[57] ABSTRACT

An apparatus arranged for directing a pressurized flow of lubricating oil into internal combustion engines oil galley system prior to operation of the engine to enhance longevity and minimize premature wear of the engine and other mechanisms utilizing a pressure feed lubricating system. The apparatus includes an accumulator reservoir of compact organization including an upper pressurized chamber separated from a lower lubrication reservoir chamber by a central flexible membrane. A solenoid valve is in fluid communication with the reservoir and the internal combustion engine oil galley system to selectively direct pressurized lubricating oil into the engine.

5 Claims, 5 Drawing Sheets

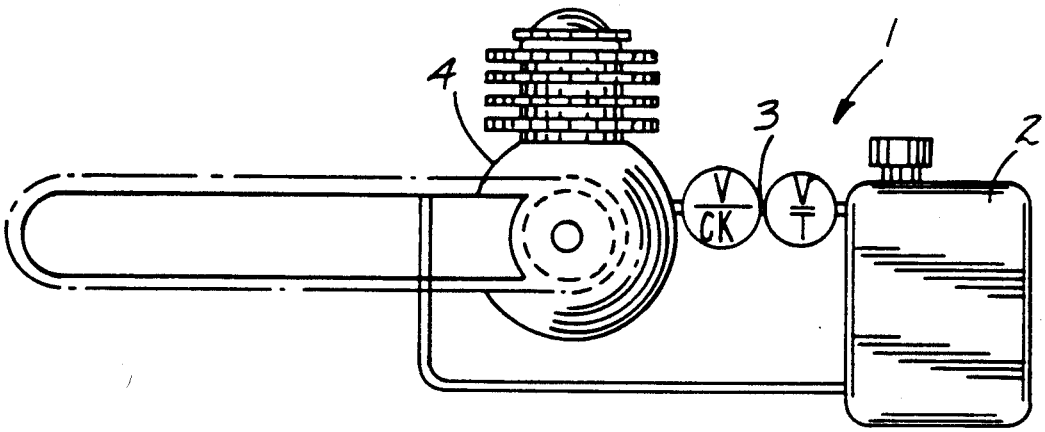
Fig 1
PRIOR
ART
Fig 2
PRIOR ART
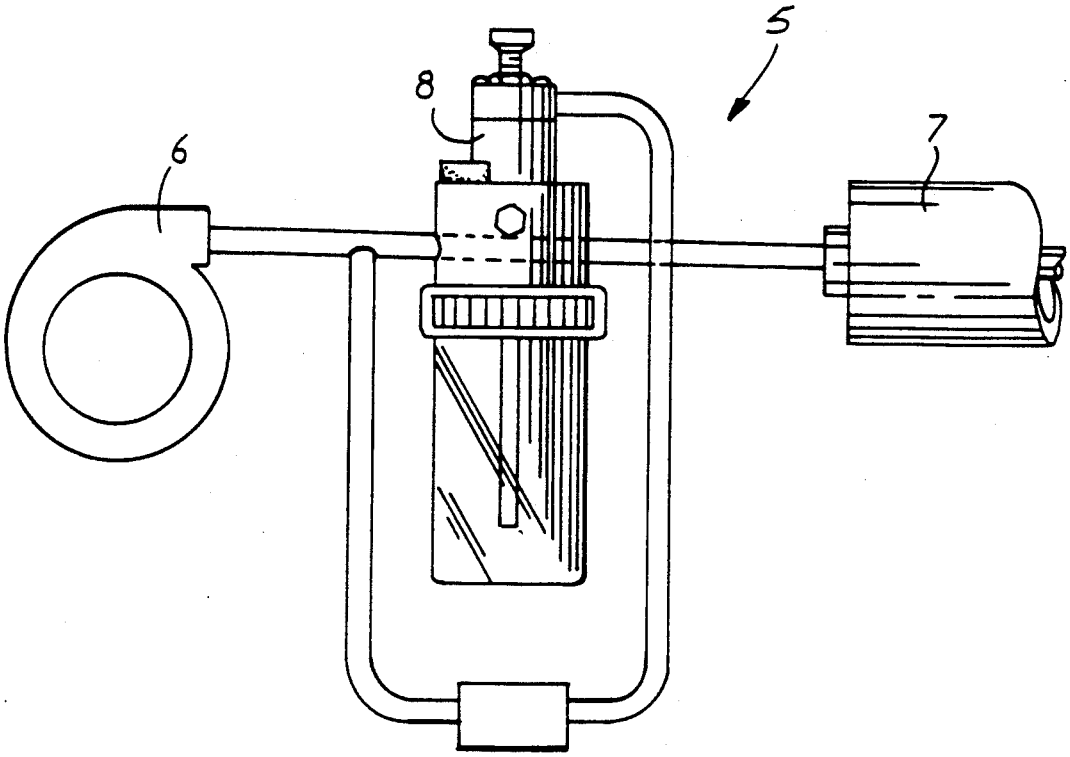

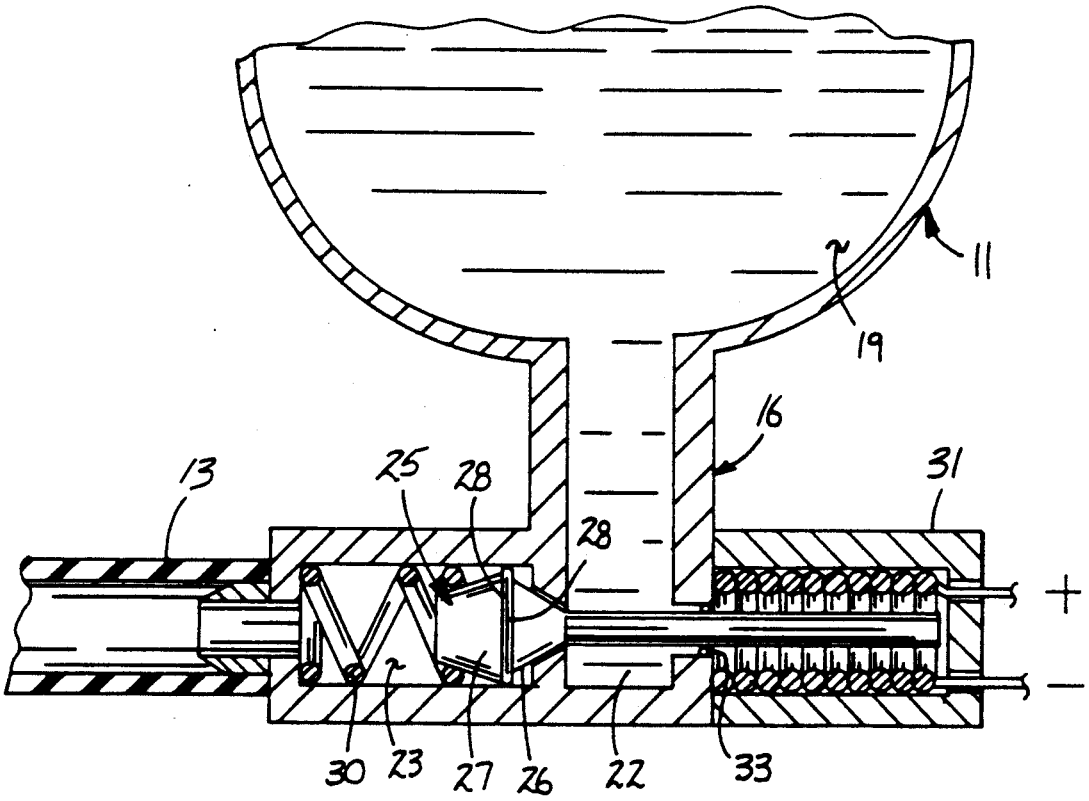
Fig 5
Fig 6
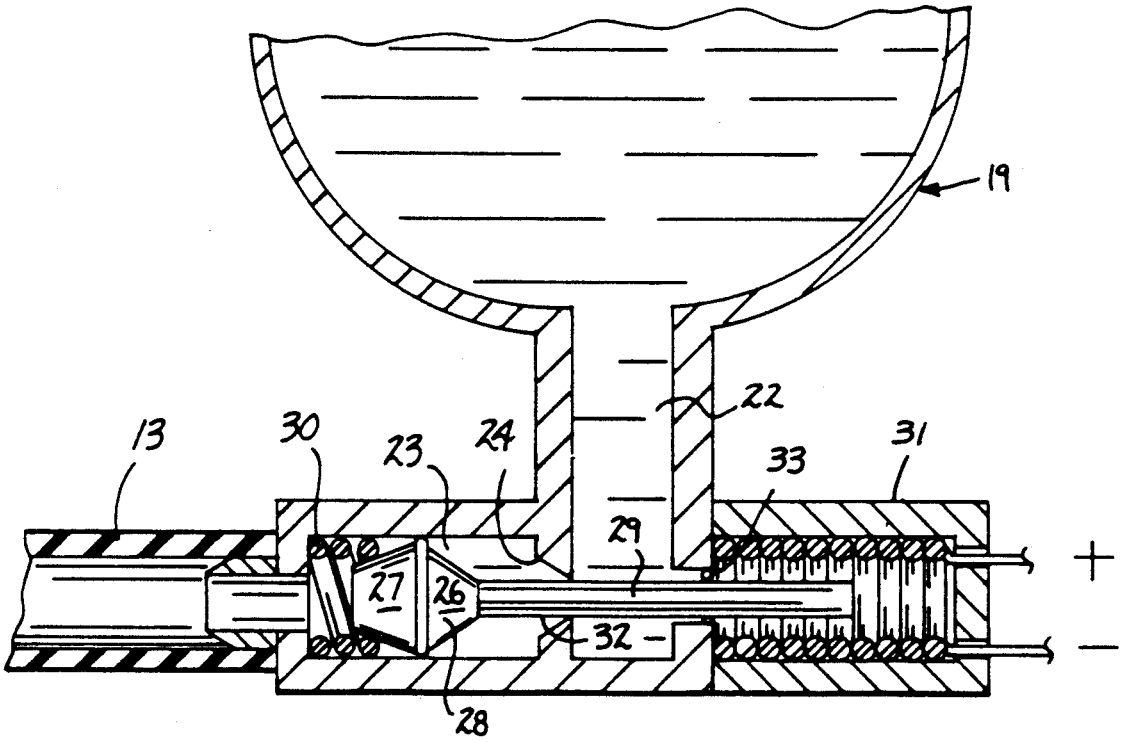

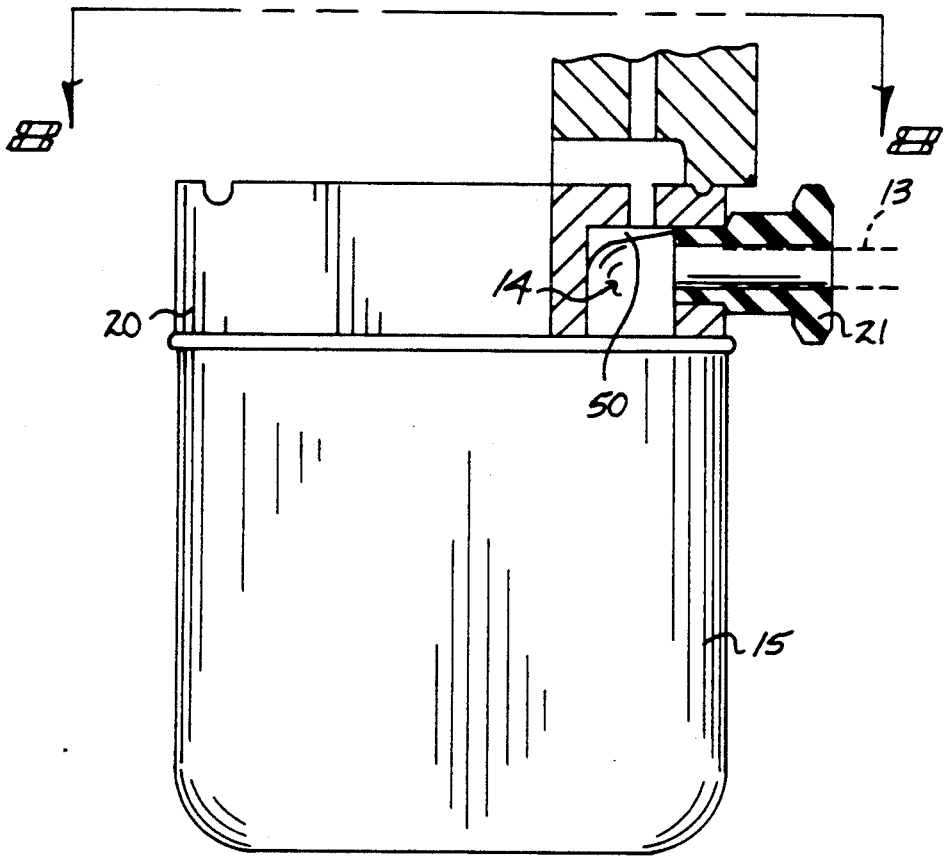
Fig 7
Fig 8
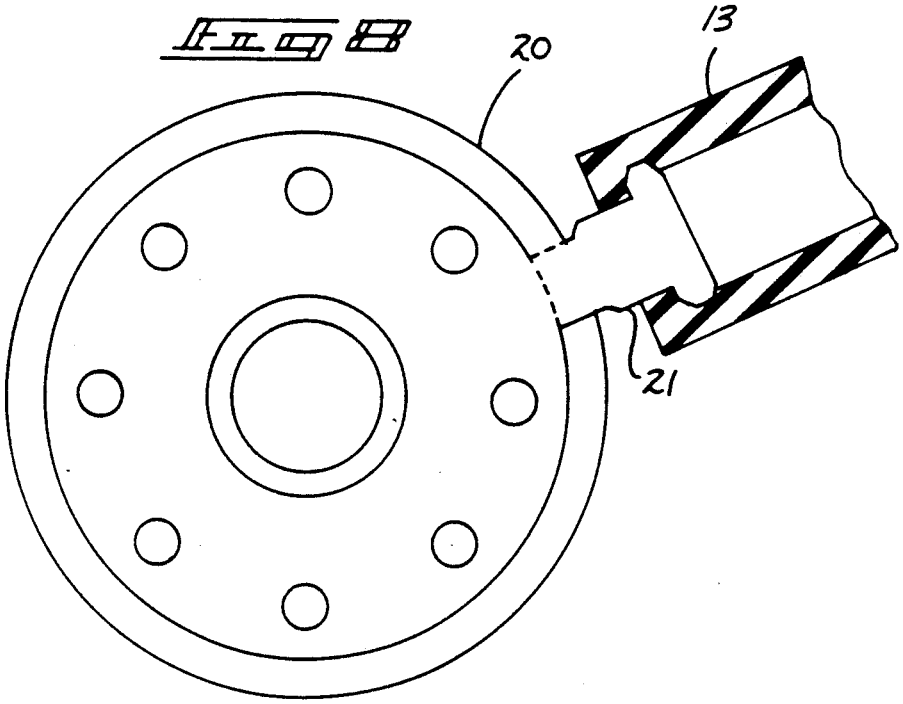

PRELUBRICATION APPARATUS

BACKGROUND OF THE INVENTION

1. Field of the Invention

The field of invention relates to lubrication apparatus, and more particularly pertains to a new and improved prelubrication apparatus to direct a quantity of fluid into an oil galley prior to use of an associated mechanism.

2. Description of the Prior Art

Initial operation during a start-up procedure of an internal combustion engine effects a greatest quantity of wear and erosion due to a limited quantity of available lubrication within the engine prior to use. The instant invention attempts to overcome deficiencies of the prior art by providing a compact and operative organization to direct lubrication fluid into an internal combustion engine prior to use. Examples of the prior art include U.S. Pat. No. 3,143,188 to Normandin wherein a cylinder is in operative communication with a lubricator that in turn is operatively associated with a remotely positioned pressurizing means to direct lubricant into the air chamber.

U.S. Pat. No. 4,802,555 to Matsunaga, et al. sets forth an oil supply system wherein a remote reservoir of lubricating oil operatively associated with an internal combustion engine of a chain saw to direct lubricating fluid into the chain saw, wherein the instant invention attempts to overcome the prior art by providing a compact valve organization to provide an effective and compact organization to direct lubricating fluid into an oil galley system of an engine, as opposed to the Matsunaga patent directing lubricating oil to the chain organization deriving pressure from the crank case system of the chain saw engine.

U.S. Pat. No. 4,101,002 to Almasy provides for an organization to lubricate a plurality of conveyor wheels mounted on opposed sides of a conveyor wherein a reservoir directs fluid to the conveyor wheels.

U.S. Pat. No. 3,767,012 to Jimi, et al. provides a pressurized oiling system for directing an oil supply to a sliding area between an inner and outer surface of a sleeve and plunger.

U.S. Pat. No. 3,423,929 to Matthews sets forth a lubricating system for use with power transmissions wherein a source of hot gas for driving a fluid motor includes a lubricator to direct a lubricant upstream of a motor inlet port of an associated motor to become entrained in the hot gas directed to the motor.

As such, it may be appreciated that there continues to be a need for a new and improved prelubrication apparatus as set forth by the instant invention which addresses both the problems of ease of use as well as effectiveness in construction in directing a pressurized flow of lubricant into an oil galley system of an internal combustion engine prior to operation of the engine and in this respect, the present invention substantially fulfills this need.

SUMMARY OF THE INVENTION

In view of the foregoing disadvantages inherent in the known types of prelubrication apparatus now present in the prior art, the present invention provides a prelubrication apparatus wherein the same permits selective directing of pressurized lubricating oil into an oil galley from a remote accumulator reservoir. As such, the general purpose of the present invention, which will be described subsequently in greater detail, is to provide a new and improved prelubrication apparatus which has all the advantages of the prior art prelubrication apparatus and none of the disadvantages.

To attain this, the present invention provides an apparatus arranged for directing a pressurized flow of lubricating oil into internal combustion engines oil galley system prior to operation of the engine to enhance longevity and minimize premature wear of the engine and other mechanisms utilizing a pressure feed lubricating system. The apparatus includes an accumulator reservoir of compact organization including an upper pressurized chamber separated from a lower lubrication reservoir chamber by a central flexible membrane. A solenoid valve is in fluid communication with the reservoir and the internal combustion engine oil galley system to selectively direct pressurized lubricating oil into the engine.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved prelubrication apparatus which has all the advantages of the prior art prelubrication apparatus and none of the disadvantages.

It is another object of the present invention to provide a new and improved prelubrication apparatus which may be easily and efficiently manufactured and marketed.

It is a further object of the present invention to provide a new and improved prelubrication apparatus which is of a durable and reliable construction.

An even further object of the present invention is to provide a new and improved prelubrication apparatus which is susceptible of a low cost of manufacture with regard to both materials and labor, and which accordingly is then susceptible of low prices of sale to the consuming public, thereby making such prelubrication apparatus economically available to the buying public.

Still yet another object of the present invention is to provide a new and improved prelubrication apparatus which provides in the apparatuses and methods of the prior art some of the advantages thereof, while simultaneously overcoming some of the disadvantages normally associated therewith.

Still another object of the present invention is to provide a new and improved prelubrication apparatus wherein the same permits retrofit and operative association of an apparatus to direct through a valve arrangement a charge of pressurized lubricating fluid into an oil galley system of an associated internal combustion engine prior to operation of the engine.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic side view, taken in elevation, of a prior art prelubrication apparatus.

FIG. 2 is an orthographic side view, taken in elevation, of a further prior art prelubrication apparatus.

FIG. 4 is an orthographic view, taken along the lines 4—4 of FIG. 3 in the direction indicated by the arrows.

FIG. 5 is an orthographic cross-sectional illustration of the solenoid valve organization of the instant invention in a closed configuration.

FIG. 6 is an orthographic cross-sectional illustration of the valve of the instant invention in an open configuration.

FIG. 7 is an orthographic side view, taken in elevation, of the filter housing assembly in association with the internal combustion engine.

FIG. 8 is an orthographic view, taken along the lines 8—8 of FIG. 7 in the direction indicated by the arrows to indicate the coupling association of the lubricant feed conduit with the filter housing.

DESRIPTION OF THE PREFERRED EMBODIMENT

Figures 3, 4A:
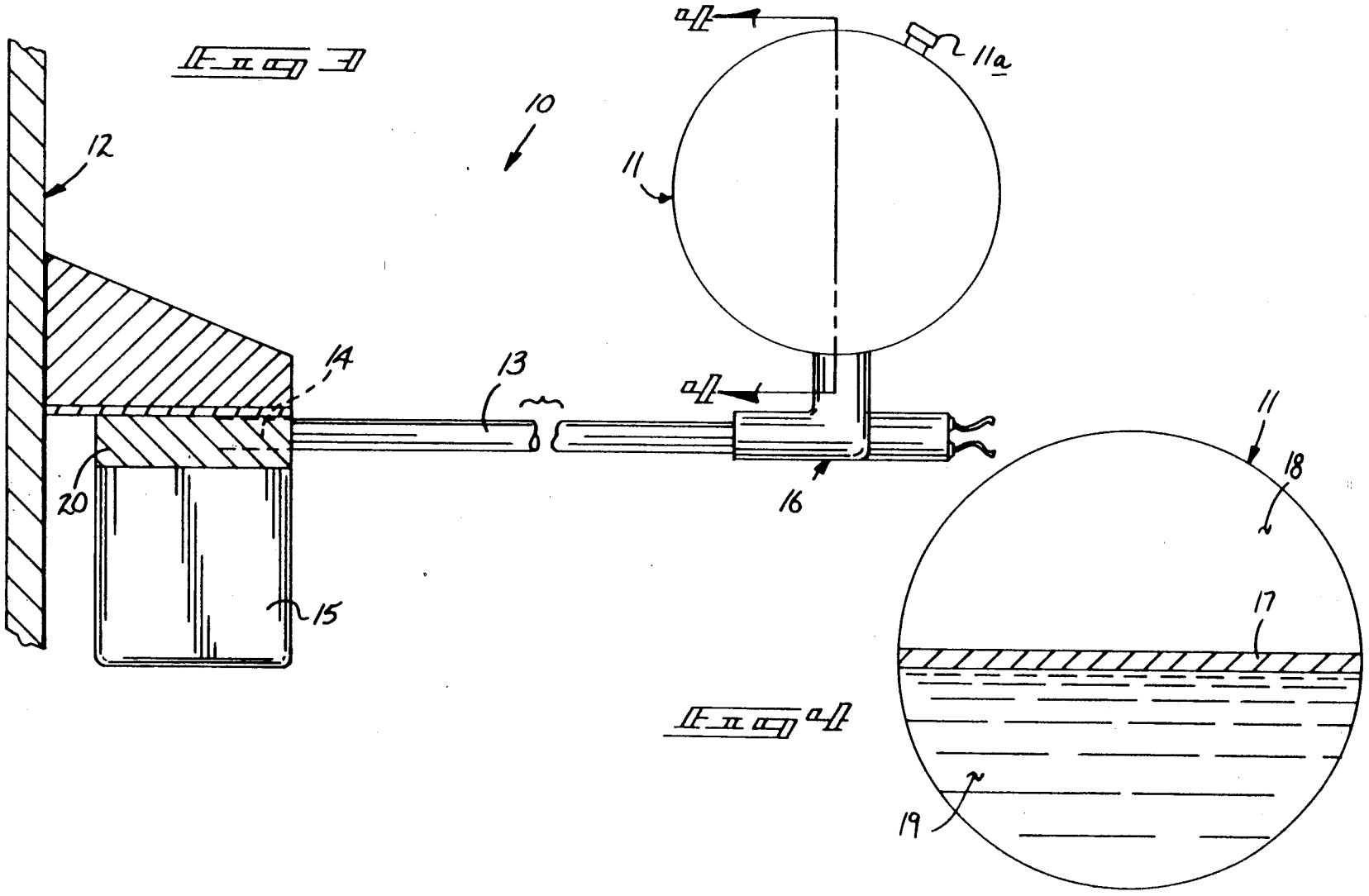
FIG. 3 is an orthographic side view, taken in elevation, of the prelubrication apparatus of the instant invention.
Figure 9:
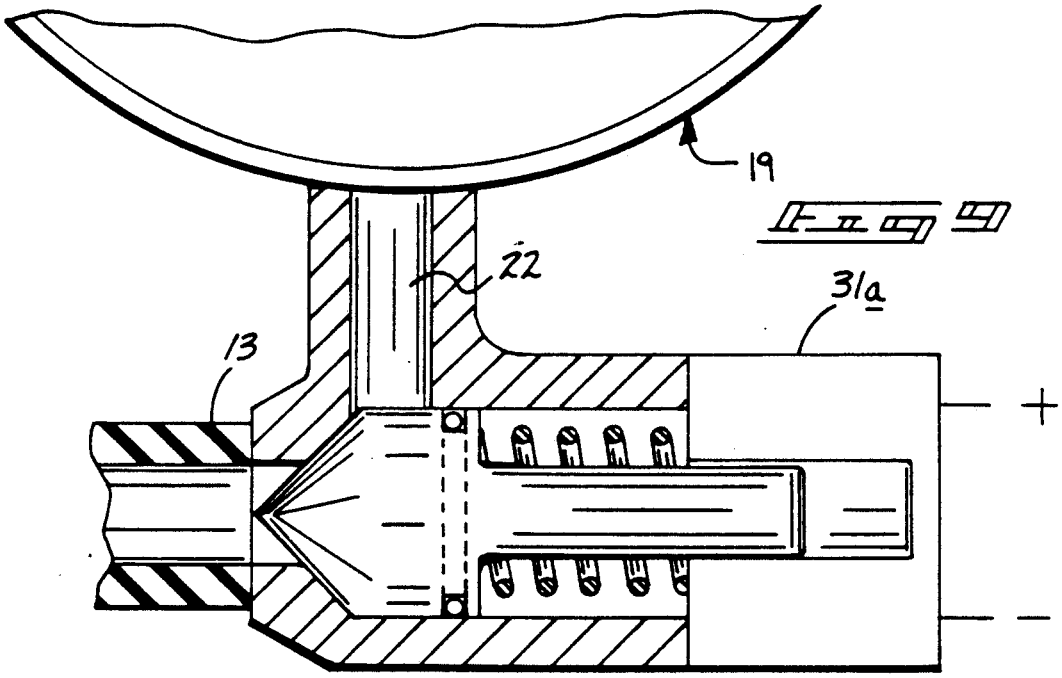
FIG. 9 is an orthographic cross-sectional illustration of a modified solenoid valve utilized by the instant invention in a closed orientation.
Figure 10:
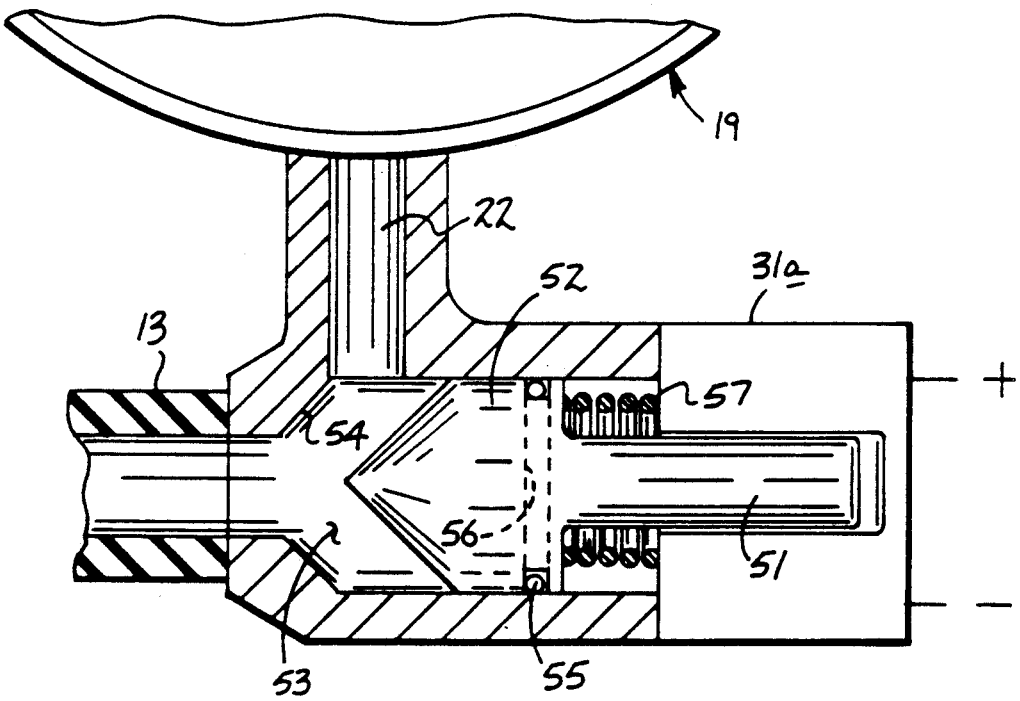
FIG. 10 is an orthographic cross-sectional configuration of the modified solenoid of the instant invention in an open orientation.

With reference now to the drawings, and in particular to FIGS. 1 to 10 thereof, a new and improved prelubrication apparatus embodying the principles and concepts of the present invention and generally designated by the reference numeral 10 will be described.

FIG. 1 illustrates a prior art prelubrication apparatus 1, wherein a lubrication reservoir 2 is cooperative through a feed conduit 3 to direct lubrication to an associated saw chain of an associated chain saw directing pressure to the reservoir 2 through the conduit 3. FIG. 2 illustrates a further prelubrication apparatus 5 wherein an air cylinder 7 receives pressurized lubrication from a lubricator 8 from a remote pressurized source 6.

More specifically, the prelubrication apparatus 10 of the instant invention essentially comprises an accumulator reservoir 11 formed with a pressurizing valve **11*a* that may be used independently or in cooperation with a pressurizing conduit driven by an associated internal combustion engine 12. The internal combustion engine 12 includes an oil filter housing operative with a check valve 50, with an oil galley conduit 14 in operative association with the oil filter housing that in turn mounts an oil filter 15. A lubricant feed conduit 13 is in fluid communication between the accumulator reservoir 11 and the oil galley conduit 14 through a solenoid valve 16 mounted to the accumulator reservoir 11. FIG. 4 illustrates the accumulator reservoir 11 with a pressurized air upper chamber 18 overlying a fluid lubricant lower chamber 19 with a flexible membrane 17 medially and coextensively mounted between the upper and lower chamber, whereupon the lower chamber is pressurized to direct the lubricant contained therewithin through the associated feed conduit 13 upon opening of the associated solenoid valve 16, to be shown in more detail an as illustrated in FIGS. 5 and 6**.

FIG. 5 illustrates the use of a valve conduit 22 in direct fluid communication with the fluid lubricant lower chamber 19 in fluid communication with a second valve conduit 23 that in turn is mounted to the lubricant feed conduit 13. A fluid passageway 32 communicates the first valve conduit 22 and a second valve conduit 23 with a conical valve seat 24 formed about the fluid passageway 32 and flaring outwardly towards the second conduit 23 to receive a rear conical valve face 26 of an associated valve member 25. The valve member 25 further includes a forward conical valve face 27 coaxially aligned with a rear concial valve face 26 and a medial abutment rib 28 formed about the valve member 25 in coaxial alignment with the rear and forward valve faces 26 and 27 respectively to provide an abutment lip for a return spring 30 with the forward conical valve face 27 providing a guide surface therefor. Further, the forward conical valve surface 27 enhances seating of the rear conical valve face 26 upon the conical valve seat 24 upon de-energizing the associated solenoid valve 31 with lubricating oil pressure within the lubricant feed conduit 13 from the associated internal combustion engine 12 imposed upon the forward conical valve face 27 to further enhance its seating within the conical valve seat 24. The abutment rib 28 is further defined by a predetermined diameter substantially equal to a predetermined diameter defined by the second valve conduit 23 to enhance alignment of the valve member 25 within the second valve conduit 23. A coaxially aligned solenoid actuator rod 29 extends rearwardly in coaxial alignment with the rear conical valve face 26 through the fluid passageway 32 and the associated first valve conduit 22 into operative association with the solenoid valve 31 and its associated electrical coil drive. A solenoid fluid seal 33 prevents lubricating fluid from the first valve conduit 22 from entering the solenoid 31.

FIGS. 7 and 8 illustrate the feed conduit coupling 21 mounted to the oil galley conduit 14 of the internal combustion engine and its coupling association with the lubricant feed conduit 13 to permit fluid communication of the lubricant feed conduit 13 with the oil galley conduit 14.

It is understood that when selective actuation of the solenoid 31 by a remote switch, the valve member 25 is projected outwardly and away from the valve seat 24 to permit fluid flow from the pressurized lubricant lower chamber 19 through the lubricant feed conduit 13 and into the oil galley conduit 14 to effect prelubrication.

A modified solenoid 31*a* is mounted between the first valve conduit 22 and the lubricant feed conduit 13. A solenoid piston 51 is telescopingly mounted within an associated solenoid valve chamber 53 that defines a solenoid valve conical face 54 defining a flow conduit in fluid communication with the lubricant conduit 13. The valve conical face 54 complementarily receives a solenoid piston conical head 52, wherein the piston 51 is in extended orientation within the chamber 53. A sealing groove 56 includes an "O" ring seal 55 therewithin formed circumferentially about the head 52, with a solenoid extension spring 57 captured between a rear surface of the conical head 52 and the solenoid body coaxially wound about the piston 51 to normally bias the head 52 in an extended orientation within the valve chamber 53 to normally effect closure of fluid flow between the first upper conduit 22 and the lubricant feed conduit 13.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A prelubrication apparatus in combination with an internal combustion engine, the internal combustion engine including an oil galley conduit in operative association with an internal combustion engine, wherein the apparatus comprises an accumulator reservoir spaced from the internal combustion engine, and a solenoid valve operatively mounted to the accumulator reservoir, and a lubricant feed conduit in fluid communication with the accumulator reservoir through the solenoid valve at a forward terminal end of the lubricant feed condiut, and a rear terminal end of the feed conduit in fluid communication with the oil galley conduit, and wherein the accumulator reservoir includes a pressurized air upper chamber with the upper chamber including a pressurizing valve to permit selective pressurizing of the upper chamber, and the accumulator reservoir including a fluid lubricant lower chamber containing a lubricating fluid therewithin, and a flexible membrane coextensive with and dividing the accumulator reservoir to effect pressurizing the lower chamber by the upper chamber, and wherein the oil galley conduit includes a feed conduit coupling with the rear terminal end of the lubricant feed conduit mounted to the feed conduit coupling, and a check valve operatively mounted to the rear terminal end of the lubricant feed conduit.

2. An apparatus as set forth in claim 1 wherein the solenoid valve includes a first valve conduit in fluid communication with the lower chamber, and a second valve conduit in fluid communication with the lubricant feed conduit, and a fluid passageway directing fluid from the first valve conduit to the second valve conduit, and the fluid passageway including a conical valve seat flared outwardly towards the second valve conduit, and a valve member overlying the valve seat in a first position, and a solenoid member selectively actuatable to space the valve member in the second position.

3. An apparatus as set forth in claim 2 wherein the valve member includes a rear conical valve face to overlie the conical valve seat in the first position, and a forward conical valve face coaxially aligned with the rear conical valve face, with the forward conical face projecting into the second valve conduit, and an abutment rib coaxially aligned with the rear and forward conical valve faces defined by a predetermined diameter, and the second valve conduit defined by the predetermined diameter to enhance alignment of the abutment rib within the second valve conduit.

4. An apparatus as set forth in claim 3 including a return spring captured within the second conduit in abutment with the forward conical valve face and the abutment rib to normally bias the valve member in the first position.

5. An apparatus as set forth in claim 1 wherein the solenoid valve includes a solenoid valve chamber in fluid communication with the lower chamber, and a further outlet in fluid communication with the lubricant feed conduit, and a solenoid conical piston reciprocatably mounted within the solenoid valve chamber, the solenoid conical piston orthogonally mounted to a solenoid piston rod, the solenoid piston rod coaxially aligned with the lubricant feed conduit, and drive means to reciprocate the solenoid piston rod within the solenoid valve chamber, and biasing means to normally bias the solenoid conical piston to effect a fluid seal between the first valve conduit and the lubricant feed conduit.

* * * * *